US005392912A

United States Patent [19]

Grubbs

[11] Patent Number: 5,392,912

[45] Date of Patent: Feb. 28, 1995

[54] SELF-SUPPORTING TEXTILE PACKAGE

[75] Inventor: Michael R. Grubbs, King, N.C.

[73] Assignee: Sara Lee Knit Products, Winston-Salem, N.C.

[21] Appl. No.: 173,681

[22] Filed: Dec. 23, 1993

[51] Int. Cl.[6] ..... B65D 85/00

[52] U.S. Cl. ..... 206/451; 206/497; 206/83.5

[58] Field of Search ..... 206/278, 388, 49, 451, 206/497, 83.5, 449

[56] References Cited

U.S. PATENT DOCUMENTS

| | | | |
|---|---|---|---|
| 2,179,303 | 11/1939 | Sides | 206/83.5 |
| 2,425,301 | 8/1947 | Browner | 206/83.5 |
| 3,404,771 | 10/1968 | Mann | 206/83.5 |
| 3,685,643 | 8/1972 | Garshelis | 206/278 X |
| 3,780,854 | 12/1973 | Ruppenthal | 206/83.5 X |
| 4,317,322 | 3/1982 | Lancaster et al. | 53/399 |
| 4,336,679 | 6/1982 | Lancaster et al. | 53/399 |
| 4,387,548 | 6/1983 | Lancaster et al. | 53/399 |
| 5,016,761 | 5/1991 | Stoddard et al. | 206/497 X |

OTHER PUBLICATIONS

Dialog Search Results for "Uni-Pak"-Shuert Industries Sales-dated Nov. 22, 1993.

Product Brochure for: Shrinklabeler Series R Date--prior to filing date of instant application.

*Primary Examiner*—Jacob K. Ackun, Jr.

*Attorney, Agent, or Firm*—Rhodes Coats & Bennett

[57] ABSTRACT

A self-supporting textile package. The package includes a first generally rectangular sheet of cardboard forming a bottom layer having an upper and lower surface. A plurality of stacks of loose cut fabric pieces are placed on the upper surface of the first sheet of cardboard. A second generally rectangular sheet of cardboard forms a top layer having an upper and lower surface. Plastic film then is used to surround both the first and second generally rectangular sheets of cardboard and the plurality of stacks of loose cut fabric pieces to form a stable, self-supporting package suitable for shipment.

27 Claims, 2 Drawing Sheets

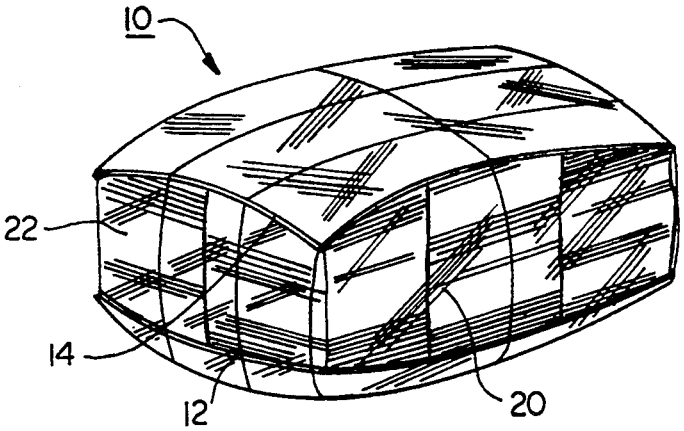
FIG. 1
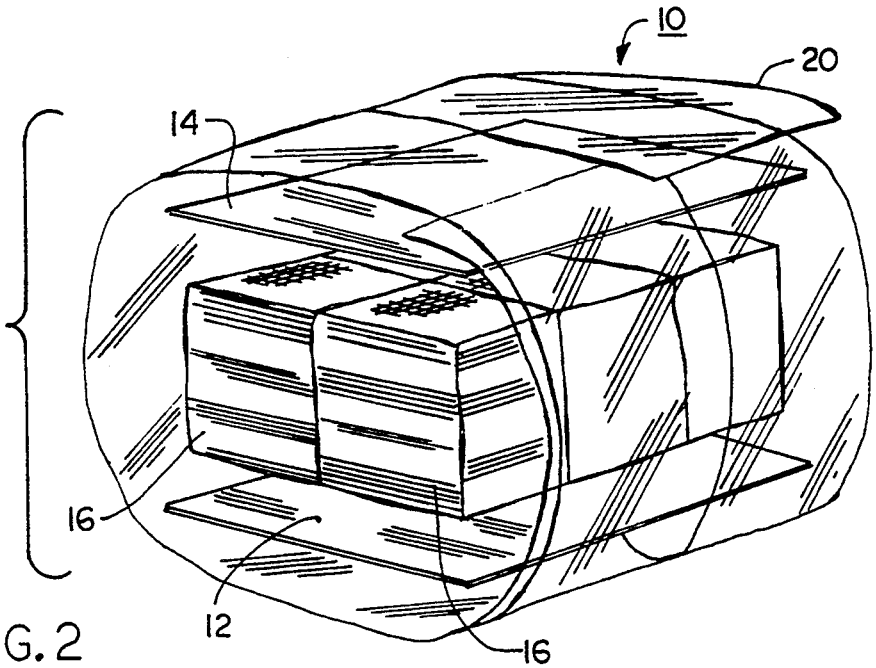
FIG. 2
FIG. 3
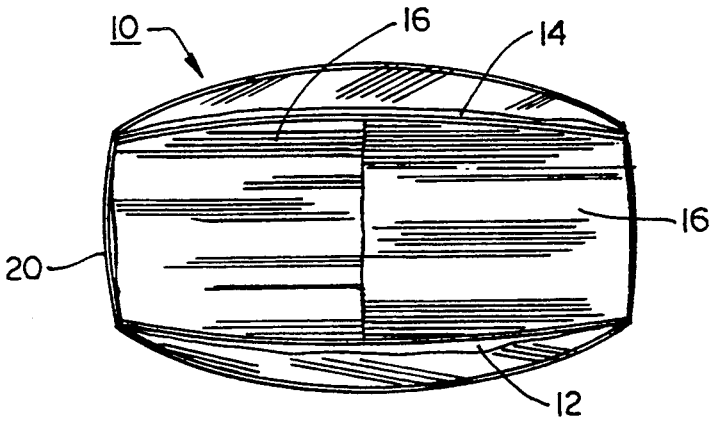

SELF-SUPPORTING TEXTILE PACKAGE

BACKGROUND OF THE INVENTION

1. Field of the Invention

The present invention relates generally to container systems and, more particularly, to a self-supporting textile package for shipping cut fabric parts.

2. Description of the Prior Art

In today's modern apparel operations, fabric is often cut to size at one location and assembled into a final garment at another location. This is done, in part, because lower cost sewing operations may be some distance away from the best site for fabric manufacturing.

Currently, individual parts for a garment are cut and matched up to provide the necessary pieces to assemble a number of garments. The parts are then packed in a cardboard container such as a "UNI-PAK" container, which consists of a plastic base and a cardboard sleeve (Uni-Pak® containers are manufactured by Shuert Industries, Sterling Heights, Mich.).

While such containers have been commercially successful, they weigh about 60 pounds each and must be returned to the fabric manufacturing plants in order to be reused. As can be appreciated, this adds significantly to the freight costs associated with moving the fabric pieces between multiple locations.

Thus, there remains a need for a new and improved self-supporting textile package which is sufficiently strong to support and protect the fabric pieces from dirt, oil and grease while, at the same time, may be discarded after one use to avoid return shipment costs.

SUMMARY OF THE INVENTION

The present invention is directed to a self-supporting textile package which forms a stable, self-supporting package suitable for shipment. The package includes a first generally rectangular sheet of cardboard forming a bottom layer. A plurality of stacks of loose cut fabric pieces are placed on the upper surface of the first sheet of cardboard. A second generally rectangular sheet of cardboard forms a top layer. Plastic film then is used to surround both the first and second generally rectangular sheets of cardboard and the plurality of stacks of loose cut fabric pieces.

In the preferred embodiment, the plastic film is first stretch wrapped about one axis parallel to the generally rectangular sheet and then is stretch wrapped about a second axis parallel to the generally rectangular sheet and generally perpendicular to the first axis.

Accordingly, one aspect of the present invention is to provide a self-supporting textile package. The package includes: (a) a generally rectangular sheet forming a bottom layer having an upper and lower surface; (b) a plurality of stacks of loose cut fabric pieces placed on the upper surface of the generally rectangular sheet; and (c) plastic film surrounding both the generally rectangular sheet and the plurality of stacks of loose cut fabric pieces, thereby forming a stable, self-supporting package suitable for shipment.

Another aspect of the present invention is to provide a self-supporting textile package. The package includes: (a) a first generally rectangular sheet forming a bottom layer having an upper and lower surface; (b) a plurality of stacks of loose cut fabric pieces placed on the upper surface of the generally rectangular sheet; (c) a second generally rectangular sheet forming a top layer having an upper and lower surface; and (d) plastic film surrounding both the first and second generally rectangular sheets and the plurality of stacks of loose cut fabric pieces, thereby forming a stable, self-supporting package suitable for shipment.

Still another aspect of the present invention is to provide a self-supporting textile package. The package includes: (a) a first generally rectangular sheet forming a bottom layer having an upper and lower surface; (b) a plurality of stacks of loose cut fabric pieces placed on the upper surface of the generally rectangular sheet; (c) a second generally rectangular sheet forming a top layer having an upper and lower surface; and (d) plastic film surrounding both the first and second generally rectangular sheets and the plurality of stacks of loose cut fabric pieces, wherein the plastic film is first stretch wrapped about one axis parallel to the generally rectangular sheet and then is stretch wrapped about a second axis parallel to the generally rectangular sheet and generally perpendicular to the first axis, thereby forming a stable, self-supporting package suitable for shipment.

These and other aspects of the present invention will become apparent to those skilled in the art after a reading of the following description of the preferred embodiment when considered with the drawings.

BRIEF DESCRIPTION OF THE DRAWINGS

FIG. 1 is a perspective view of a textile package constructed to the present invention;

FIG. 2 is an exploded perspective view of the textile package shown in FIG. 1, utilizing one direction wrapping only;

FIG. 3 is an end elevational view of the textile package shown in FIG. 1, utilizing one direction wrapping only.

DESCRIPTION OF THE PREFERRED EMBODIMENTS

Figure 4:
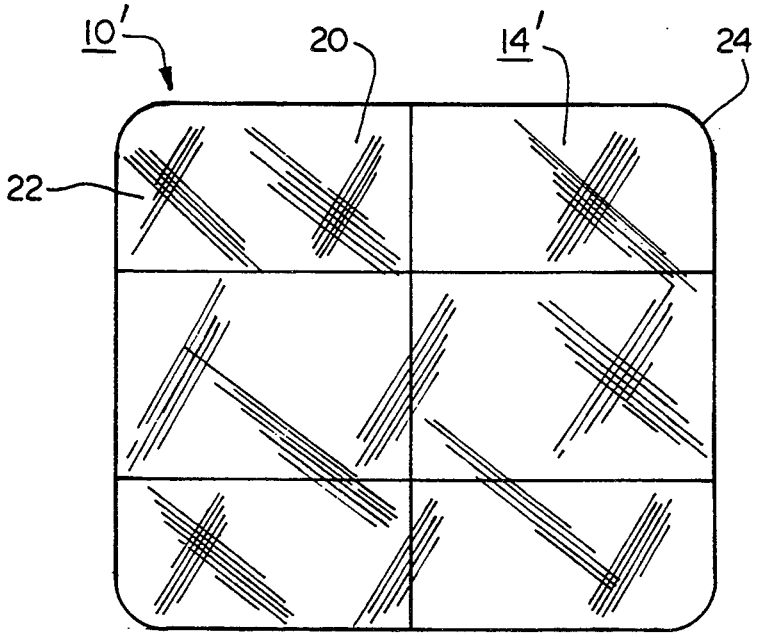
FIG. 4 is a top plan view of the textile package, shown in FIG. 3, with the addition of bi-directional wrapping and rounded corners.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a self-supporting textile package, generally designated 10, is shown constructed according to the present invention.

Package 10 includes a bottom sheet 12 of corrugated cardboard and a top sheet 14 also of corrugated cardboard. In the preferred embodiment, the sheets are generally square and are about 48"×54". In the preferred embodiment, the fiber board of cardboard has a weight of about 2-½ ounces per square foot. While the corners are generally pointed at 90°, they could be rounded for some applications as shown in FIG. 4.

Between the bottom sheet 12 and top sheet 14, there are placed multiple stacks of cut fabric pieces. In the preferred embodiment, the fabric pieces are unbundled and otherwise unstable. But some bundling could be used for particularly unstable, knitted fabric pieces.

Between about 400 to 600 pounds of fabric pieces are stacked between bottom sheet 12 and top sheet 14.

In the preferred embodiment, plastic wrap 20 is stretch wrapped across one direction of the package containing the top sheet, bottom sheet and unbundled fabric pieces. A second wrapping of plastic wrap 22 is then applied at 90° to the first wrapping. Preferable, the plastic used is between about 1 to 2 mils in thickness. Also in the preferred embodiment, the plastic is transparent to permit the cut fabric pieces to be viewed along the sides to aid in identification of the goods therein. This technique maintains compression and shape of the fabric pieces and assures that the wrapping is doubled on the top and bottom.

In the preferred embodiment, the present invention utilizes a horizontal "ring" wrapping machine to apply stretch-wrap plastic around stacked, cut fabric pieces with sheets of corrugated cardboard on the top and bottom of the package. The wrapped goods are then conveyed out of the wrapper, indexed 90°, conveyed back into the machine and wrapped again. This technique maintains compression and shape of the package and assures that the wrapping is doubled on the top and the bottom. The benefit of this system and technique are that the cut goods are compressed, no UNI-PAK container is required and the stacks may be loaded 3 high. When used to supply remote apparel sewing plants, this invention results in significant freight savings.

One ring-type horizontal stretch-wrap machine which has proven particularly satisfactory is a Lanringer Stretch Wrapper available from Lantech, Inc. of Louisville, Ky. The basic structure of this device is described in U.S. Pat. Nos. 4,302,920; 4,317,322; 4,336,679; and 4,387,548. The entire disclosure of these patents is hereby incorporated by reference.

Alternatively, instead of stretch wrapping, it is believed that this process could equally be carried out with a shrink-wrap machine such as is available from PDC International Corporation of South Norwalk, Conn. Both types of processing machines are capable of forming continuous plastic outer layers. While such systems have been used in the past to ship rolls and bundles of apparel, loose or unbundled cut pieces of fabric have been considered too unstable to stretch-wrap or shrink-wrap.

Turning to FIG. 2, there is shown an exploded perspective view of the textile package shown in FIG. 1, utilizing wrapping in one direction only. While wrapping in two directions provides a more stable package and eliminates the possibility that the ends of the cut fabric pieces will be exposed to dirt, oil or grease, for a more stable fabric bundle, wrapping only in one direction and only a bottom sheet is expected to be necessary. However, to obtain the maximum advantages of the invention, it has been found that it is best to use both a top and bottom sheet 12, 14 and wrap in both direction transverse to one another.

Turning to FIG. 3, there is shown an end elevational view of the textile package shown in FIG. 1. As can be seen, the corners of the top sheet 12 and bottom sheet 14 have a tendency to bow under compression by plastic sheet 20. However, this bowing is not substantial and the self-supporting textile package according to the present invention may be stacked 2 to 4 high with 3 being preferred.

Finally, FIG. 4 shows an top plan view of the textile package shown in FIG. 3. As can be seen, the cross-wrapping of the plastic film 20, 22 forms a grid across the surface of the top and bottom which further stabilizes the package.

While in the preferred embodiment the goods are wrapped in one direction, conveyed out of the wrapper, indexed 90°, and conveyed back into the machine and wrapped again, other techniques could also be used. For example, two wrappers located at 90° with one another could wrap the goods in one direction and transfer the goods to the second wrapper located at 90° to the first wrapper to wrap the package perpendicular to the first wrapping. Also, as discussed above, it is envisioned that the package according to the present invention could also be made using shrink wrapping, instead of stretch wrapping in some situations.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A self-supporting textile package, said package comprising:

(a) a generally rectangular sheet forming a bottom layer having an upper and lower surface;

(b) a plurality of individual stacks of loose cut fabric pieces placed on the upper surface of said generally rectangular sheet; and (c) plastic film surrounding both said generally rectangular sheet and said plurality of stacks of loose cut fabric pieces, wherein said plastic film is wrapped about a first horizontal axis parallel to said generally rectangular sheet, thereby forming a stable, self-supporting package suitable for shipment.

2. The package according to claim 1, wherein said generally rectangular sheet is square.

3. The package according to claim 1, wherein said generally rectangular sheet has rounded corners.

4. The package according to claim 1, wherein said generally rectangular sheet is formed from corrugated cardboard.

5. The package according to claim 4, wherein said generally rectangular sheet formed from corrugated cardboard has a weight of about 2-½ oz/sq.ft.

6. The package according to claim 1, wherein said plastic film also is wrapped about a second horizontal axis parallel to said generally rectangular sheet and generally perpendicular to said first axis.

7. The package according to claim 6, wherein said plastic film is stretch wrapped.

8. The package according to claim 6, wherein said plastic film is shrink wrapped.

9. The package according to claim 1, wherein said plastic film is between about 1 to 2 mils in thickness.

10. The package according to claim 1, wherein said plastic film is transparent.

11. A self-supporting textile package, said package comprising:

(a) a first generally rectangular sheet forming a bottom layer having an upper and lower surface;

(b) a plurality of individual stacks of loose cut fabric pieces placed on the upper surface of said generally rectangular sheet;

(c) a second generally rectangular sheet forming a top layer having an upper and lower surface; and (d) plastic film surrounding both said first and second generally rectangular sheets and said plurality of stacks of loose cut fabric pieces, wherein said plastic film is wrapped about a first horizontal axis parallel to said generally rectangular sheet, thereby forming a stable, self-supporting package suitable for shipment.

12. The package according to claim 11, wherein said first and second generally rectangular sheets are square.

13. The package according to claim 11, wherein said first and second generally rectangular sheets have rounded corners.

14. The package according to claim 11, wherein said first and second generally rectangular sheets are formed from corrugated cardboard.

15. The package according to claim 14, wherein said first and second generally rectangular sheets formed from corrugated cardboard have a weight of about 2-½ oz/sq.ft.

16. The package according to claim 11, wherein said plastic film also is stretch wrapped about a second horizontal axis parallel to said generally rectangular sheet and generally perpendicular to said first axis.

17. The package according to claim 11, wherein said plastic film is between about 1 to 2 mils in thickness.

18. The package according to claim 11, wherein said plastic film is transparent.

19. The package according to claim 11, wherein said plastic film is stretch wrapped.

20. The package according to claim 11, wherein said plastic film is shrink wrapped.

21. A self-supporting textile package, said package comprising:

(a) a first generally rectangular sheet forming a bottom layer having an upper and lower surface;

(b) a plurality of individual stacks of loose cut fabric pieces placed on the upper surface of said generally rectangular sheet;

(c) a second generally rectangular sheet forming a top layer having an upper and lower surface; and (d) plastic film surrounding both said first and second generally rectangular sheets and said plurality of stacks of loose cut fabric pieces, wherein said plastic film is first stretch wrapped about one horizontal axis parallel to said generally rectangular sheet and then also is stretch wrapped about a second horizontal axis parallel to said generally rectangular sheet and generally perpendicular to said first axis, thereby forming a stable, self-supporting package suitable for shipment.

22. The package according to claim 21, wherein said first and second generally rectangular sheets are square.

23. The package according to claim 21, wherein said first and second generally rectangular sheets have rounded corners.

24. The package according to claim 21, wherein said first and second generally rectangular sheets are formed from corrugated cardboard.

25. The package according to claim 24, wherein said first and second generally rectangular sheets formed from corrugated cardboard have a weight of about 2-½ oz/sq.ft.

26. The package according to claim 21, wherein said plastic film is between about 1 to 2 mils in thickness.

27. The package according to claim 21, wherein said plastic film is transparent.

* * * * *